US005951573A

United States Patent [19]

Yashar

[11] Patent Number: 5,951,573

[45] Date of Patent: Sep. 14, 1999

[54] MANUAL DEPILATORY DEVICE

[76] Inventor: Parviz Yashar, 6261 Lena Ave., Woodland Hills, Calif. 91367

[21] Appl. No.: 09/079,369

[22] Filed: May 15, 1998

[51] Int. Cl.[6] ..... A61B 17/50

[52] U.S. Cl. ..... 606/133; 606/43

[58] Field of Search ..... 606/133, 131, 606/1, 43

[56] References Cited

U.S. PATENT DOCUMENTS

| | | | |
|---|---|---|---|
| 1,743,590 | 1/1930 | Binz | 606/133 |
| 4,033,350 | 7/1977 | Hoshi | 606/43 |
| 4,658,456 | 4/1987 | Tsai . | |
| 4,923,460 | 5/1990 | Amit | 606/133 |
| 4,983,175 | 1/1991 | Daar et al. . | |
| 5,133,722 | 7/1992 | Avrahami et al. . | |
| 5,312,419 | 5/1994 | Garenfeld et al. . | |
| 5,515,587 | 5/1996 | Pool . | |
| 5,557,874 | 9/1996 | Pietrandrea et al. . | |
| 5,643,287 | 7/1997 | Ahad | 606/133 |

*Primary Examiner*—Michael Buiz
*Assistant Examiner*—Kevin Truong
*Attorney, Agent, or Firm*—Kelly Bauersfeld; Lowry & Kelley, LLP

[57] ABSTRACT

A depilatory device includes a pair of base members pivotally connected to one another and which support, at opposite ends of each base member, a pair of anchors that extend generally perpendicularly from the base members. A pair of string-like elongated elements arranged in mutually twisted engagement are attached to the anchors in such a manner such that the coils formed by the elongate elements travel linearly along the length of the depilatory device as the base members pivot with respect to one another. The result in an effective hair engagement and removal assembly.

12 Claims, 10 Drawing Sheets

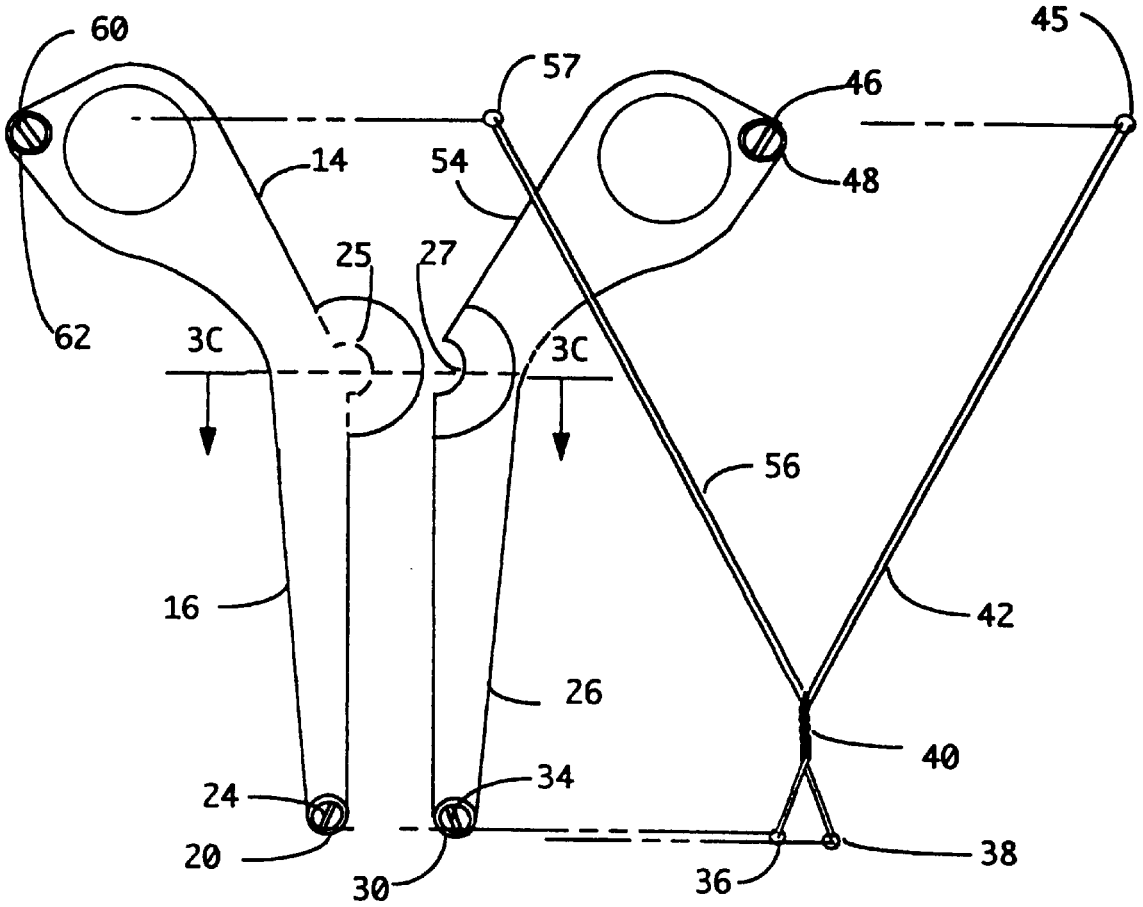
FIG.3A
FIG.3B
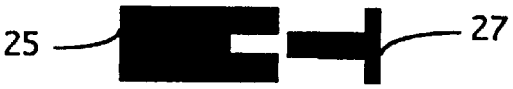
FIG.3C

MANUAL DEPILATORY DEVICE

BACKGROUND OF THE INVENTION

This invention relates generally to depilatory devices and techniques. More specifically the present invention relates to manual or hand-held depilatory devices.

The earliest known depilatory device, probably made during the seventeenth or eighteenth centuries, originated somewhere in near, middle, or far East Asia. The device was simply a piece of silk or cotton string which was folded approximately in half. The folded string was held at both ends and was twisted a few times, forming several coils in the middle of the fold. To remove hair the thumb and the forefinger were placed in the loop, one end of the string was held with the other hand and the other side was held at a tension by the teeth or looped and tied around the neck. The string was manipulated by moving the thumb and forefinger by bringing them together and taking them apart at the tips while simultaneously the opposite of this action was done at the two other ends, (the teeth or neck and the other hand). This manner of manipulating the strings caused the coil formation collectively to move linearly back and fourth. When the coils were put on the skin and set in motion by manipulating the string, hair could be engaged by the loops and removed from the skin.

Although this method of depilation was simple and efficient, it was not only awkward but a second individual was needed to perform the operation.

Various types of mechanical depilatory devices have been proposed and are known in the market place.

U.S. Pat. No. 4,983,175 to Daar et al. (1991) illustrates an electrically powered depilatory device including a hand held portable housing, a hair engagement and removal assembly including elongate elements in mutually twisted engagement and a motor for driving the elongate elements in motion, whereby hair is engaged between the elongate elements and thus removed. The disadvantages of the device are that:

(a) It is powered electrically therefore it cannot be used where electricity is not available;

(b) It's not sufficient or practical to use on facial hair especially in places such as the eyebrows and hair above the lips;

(c) One is unable to see exactly what hair is being removed because the housing covers the strings that remove the hair; and (d) The device is continuously working in one direction, and therefore might accidentally remove the wanted hair especially since the operating tip of the device being the elongate elements are covered by the housing.

U.S. Pat. No. 5,133,722 to Avrahami (1992) illustrates a method and device for plucking hair by engaging the hair with a hair-plucker body to clamp the hair thereto, moving the hair-Plucker body and the hair clamp in the plucking direction with respect to skin, and successively interpreting the movement of the hair-plucker body by a series of short tugs to the hair until it is plucked from the skin. The disadvantages of the device are: a) the device processes very slowly; b) it can only be used on the face; c) it is unpractical for any other part of the body; d) it can only be used were electricity is available; and e) It removes the hairs one at a time therefore taking a long time to pluck the hair.

U.S. Pat. No. 5,312,419, to Garenfeld (1994) shows an invention that relates to a depilation apparatus provided with a depilation member having pinching elements for consecutively holding hairs, and clamping and pulling said hairs from the skin. The disadvantages of this device are: a) it can only be used were electricity is available therefore it cannot be used without electricity; b) it is too fast, therefore too painful; and c) it is hard to control and it is too wide to be used for facial hair.

Accordingly, there remains a need for a depilatory device that has a simple mechanism which can be manufactured inexpensively so that consequently it is affordable to most potential users, which is portable and may be used anywhere, and whose operation does not depend on availability of electricity or use of batteries. Additionally, a depilatory device is needed that accurately plucks the hair from wanted areas and provides control over how much hair it plucks that is useable and sanitary for more than one person because the portion that plucks the hair and comes in contact with the skin is changeable for each person when desired, and is durable and reliable with long life and does not need any repairs that the user is not able to perform. Moreover, such a device is needed hat does not hide any of it's parts or elements by any housing or cover, is easy to assemble and reassemble, and allows the user to see the hair that is being plucked while it is being plucked. The present invention fulfills these needs and provides other related advantages.

SUMMARY OF THE INVENTION

In accordance with the present invention, a manual depilatory device is comprised of a hair engagement and removal assembly including two elongate elements in which the two elongate elements are arranged in mutually twisted engagement, forming two or three coils in a linear manner. Thus the said elongate element collectively will have four ends, and a distal knot is provided at their distal ends.

A manually pivoting mechanical drive assembly including two handles, drive the entire hair engagement and removal assembly. Said handles (when interlocked at the pivot) collectively resemble a pair of scissors, with the exception that when the device is at it's normal or rested position, the finger loops of the handles are distanced from each other. When the finger loops are pressed together or pivoted, the ends on the other side of the pivot that are adjacent move away from each other simultaneously (a reverse action to that of the scissors). Said handles collectively consist of two finger loops at one side of the pivot, and two elongated members that are thinner than the rest of the handles therefore more flexible than the rest of the structure which is thicker and rigid. When interlocked at the pivot the handles form four distal branches so that each handle at their distal ends are curved, extending proximally perpendicular in respect to its longitudinal spine, resulting in two branches at opposite sides of said pivot point. Each branch at its distal end is provided with a groove, and a notch located at the base and distal end of the groove, whereby each elongate element is placed in said groove so that the distal knots are adjacent and held from slipping or getting free from the said groove while held in tension imposed by the bowed and flexed condition of said flexible elongated elements.

Thus the hair engagement and removal assembly is suspended and held in tension at four points, while forcing the handles adjacent and interlocked at a fulcrum, whether the device is at rest or manually pivoting.

Said mechanical assembly manipulates the elongate elements and sets the coils (the portion of elongate elements in twisted engagement) in a linear motion, along their longitudinal center line. Consequently the linear motion of coils engages the hair and removes it from skin.

In accordance with the present invention this depilatory device comprises a structure that uses two elements held in tension and two compression members to achieve it's purposes. The present invention provides the minimum number of parts, simplest method of assembly, easiest replacement of parts, no need of electricity or motors, uses less materials collectively, is lighter, and the cost of manufacturing is lower, in respect to all prior inventions known to me at the present time.

As far as the advantages of the present intention in respect to its performance and functionality is concerned, it has the following advantages which are great in respect to prior art:

(a) It removes the hair accurately at the designated places, both from body and face in a linear fashion, thus being capable of removing facial hair under eyebrows, and above the lips;

(b) The user is able to see where the hair is being removed;

(c) More than one hair is removed at a time when desired at the designated direction therefore it is not slow or sloppy;

(d) It does not depend on the availability of electricity or use of batteries;

(e) A device is provided that is useable and sanitary for more than one person because the portion that plucks the hair and comes into contact with the skin (the elongate elements) are changeable for each person when desired;

(f) The device plucks hair in both linear directions (back and forth travel of coils); and (g) Because of it's unique assembly it is easy to change the two elements that come in contact with the skin.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings closely related figures have the same number but different alphabetic suffixes.

FIG. 1A is the perspective view of the device turned over (a different view) the preferred embodiment.

FIG. 3A shows the basic 2 handles structure separated (not interlocked) at the fulcrum.

FIG. 3B shows the elongate elements in the twisted engagement with and shows it's relation to the handles FIG. 3A.

FIG. 3C shows a sectional view of the fulcrum, a preferred embodiment.

FIG. 9A is the sectional view of FIG. 9B.

DETAILED DESCRIPTION OF THE PREFERRED EMBODIMENTS

FIGS. 1A to 14C

Figure 1A:
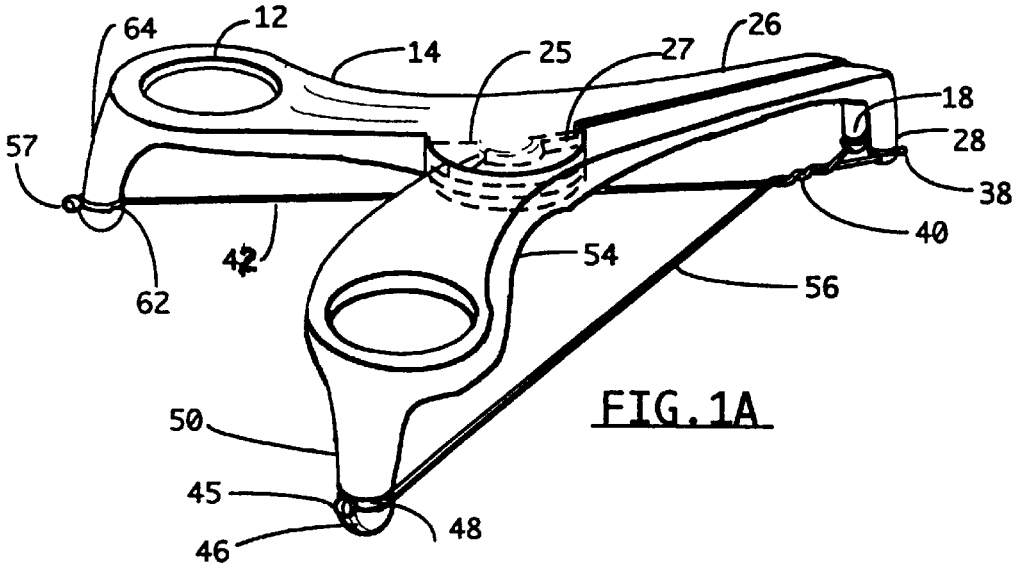
FIGS. 1A and 1B show the perspective drawing of the entire manual depilatory device in it's normal rested position.
Figure 1B:
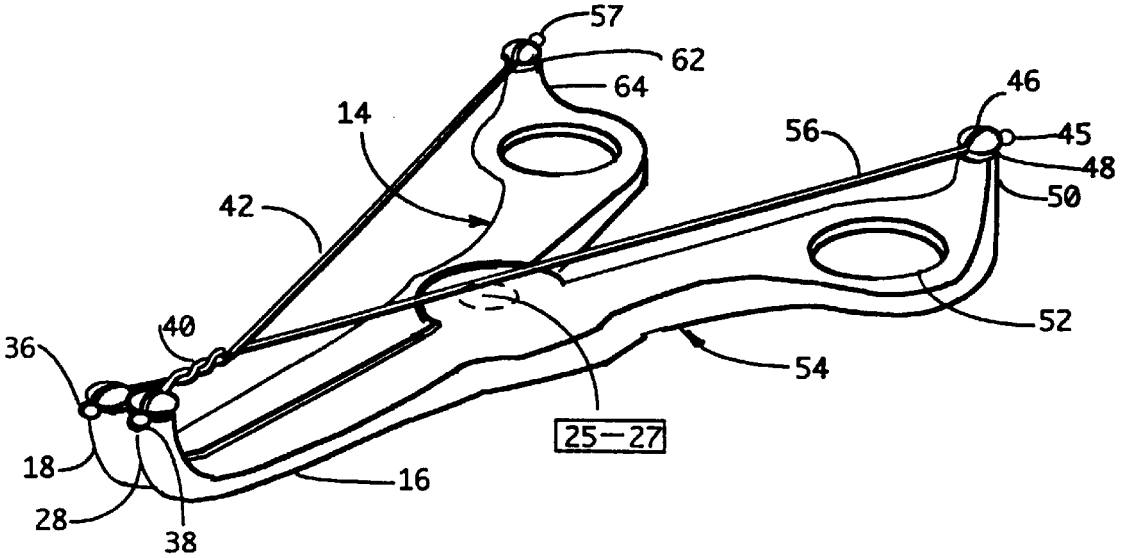

Reference is now made to FIGS. 1A and 1B which illustrate two different perspective views of the present invention. A depilatory device constructed and operative in accordance with a preferred embodiment of the invention. FIG. 1A the manual depilatory device comprises of a hand held pivoting two part semirigid, as seen in reference numerals 14 and 54. The two handles 14 and 54 are arranged in the manner that they are adjacent at the pivot point 25 and 2. Which are separately integrated with each other and either handle 14 and 15. The handles 14 and 54 are also arranged so that two distal branches 18 and 28 are adjacent while the other two distal branches 50 and 64 are as far distanced as allowed from each other, as the handles 14 and 54 except at the fulcrum are symmetrical and identical. The handles 14 and 54 in the preferred embodiment are made of flexible plastics such as Polypropylene, however any plastic that can be flexed repeatedly and still retain it's shape would be practical and functional each handle. Each handle 14 consists of (a) a distal branch 64, (b) a finger loop 12, an (c) integrated portion of (d) pivot center 25, (f) a prolonged or elongated member 26. The prolonged member is constructed thinner in the middle, to flex and bend when two distal branches 64 an 50 at one side and 18 and 28 on the other side of the pivot are collectively pulled towards the center and each other by means of a common tension.

Reference now is made particularly to FIG. 1B. All distal branches 18-28-50-64 are identical and at their distal ends. A typical groove 46 and at the base of the typical grooves 46 a typical lead in notch 48 is formed. The grooves are all angled in their longitudinal direction so that if continued towards each other they proximally cross at location of where the coils 40 (will be explained below) are located. All grooves at their width provide just enough space so that the elongate elements 42–56 (will be described further below) individually may be laid in and removed (from each groove) The typical lead in notch 48 is located at the base of each and every groove such as 46, so that the groove cuts through and is adjacent to the lower lip of the notch.

The notches (typically 48) serve as two (a–b) basic structural purposes (which will be more evident in other drawings).

(a) it provides an exact location at base of the groove and middle of the notch for placing knotted ends, 36-38-45-57 of elongate elements numeral references 42–52.

(b) it provides a location for elastic loops tied to the end of elongate elements that provide a tension (an alternative to flexibility of prolonged members when they are not made of flexible materials).

In accordance with a preferred embodiment of the invention, a hair engagement and removal assembly comprised of two elongate elements as seen in reference numerals 42 and 56. These two elongates are engaged and twisted to form at least two but preferably three coils as shown by numeral reference 40. These elongate elements 42 and 56 are identical and are made of flexible materials such as nylon, dacron, silicone, polyester or any durable and flexible material formed by methods of extruding or injection molding. The elongate elements at their distal ends 36-38-45-57 are enlarged by means of a knot. These elongate elements may also be formed larger than the rest of the element when first manufactured by injection molding methods. Consequently when the elongate element is placed within any of the grooves such as typically numeral reference 46 and pulled toward the opposite end of the device, the end of the elongate element typically 45 will be locked at the cross section of typical groove 46 and typical leading notch 48 as shown in FIGS. 1A and 1B.

The following steps must be taken to assemble the entire device as shown in FIGS. 1A and 1B:

(a) Each of the enlarged or knotted ends are placed within their designated area.

Figure 2:
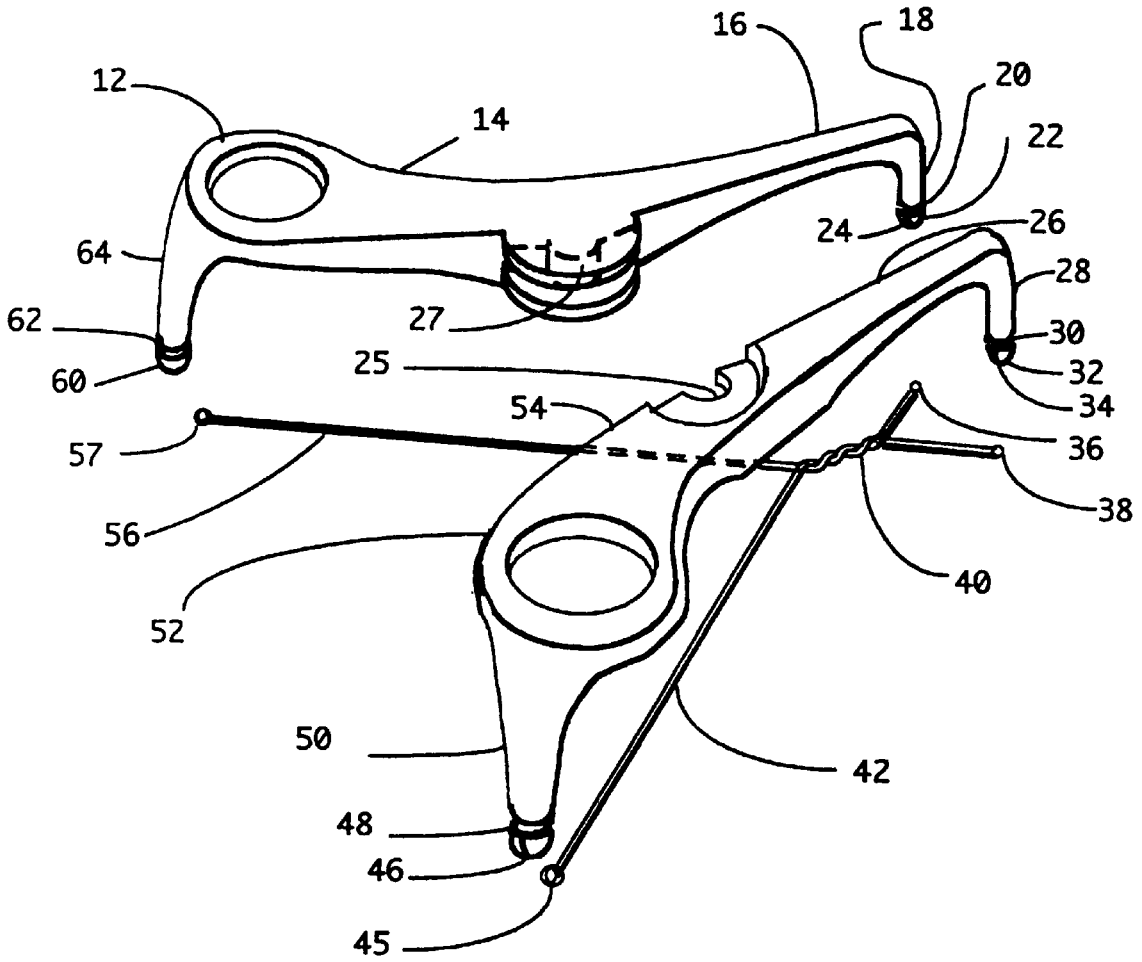
FIG. 2 shows a perspective exploded view of the device.

(b) While the elements are in their twisted engagement, the other ends of the elements are individually pulled and placed in their designated location. Consequently the prolonged members 26 and 16 will be slightly bent or bowed, and the entire hair engagement and removal assembly is held together by the compression and tension of the members of the device. FIG. 2 shows in perspective, the exploded view of the entire device with all of the reference numerals of a preferred embodiment of the invention. FIG. 3A is a plan view of the handles separated with fulcrum 27 and 25 exposed as both parts of the fulcrum 27 and 25 are integrated in each of the handles 14 and 54. When the device is completely assembled, 25 and 27 will lock at the center of the pivot. FIG. 3B shows the elements 56 and 42 (the hair engagement and removal assembly) in their engaged and twisted arrangement in relation to the handles 14 and 54. FIG. C shows a sectional view of the fulcrum 27 and 25 in relation to FIG. 3A. The fulcrum as shown is designed so that when the device is assembled, handles 14 and 54 are adjacent to each other and the portion fulcrum 27 is sandwiched in the portion fulcrum 25, so that handles 14 and 54 will be interlocked at the fulcrum. When the handles 14 and 54 are pivoted, they pivot in a reverse manner to that of a conventional pair of scissors.

Figures 4A, 4B, 4C:
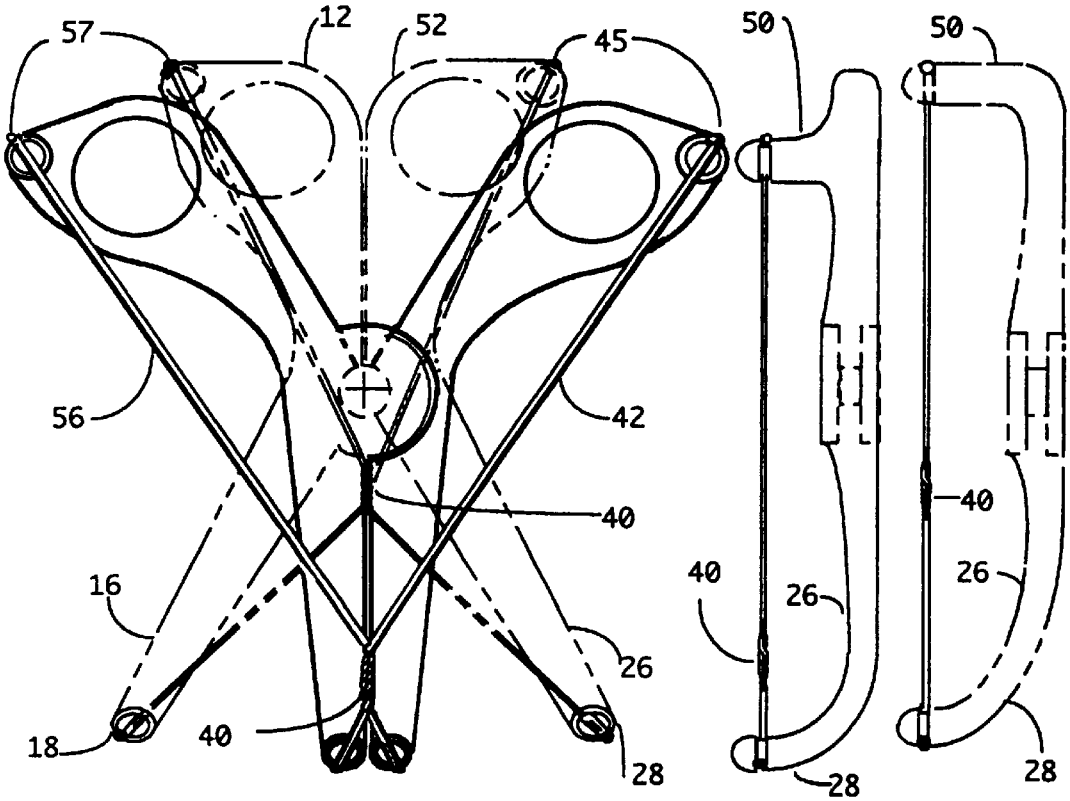
FIG. 4A shows the device in different pivoting positions and shows the position of coils in comparison.
FIG. 4B shows a side view of the device in a rested position.
FIG. 4C shows a side view of the device in pressed position.

FIG. 4A shows a plan view of the entire device in accordance with the presently preferred embodiment of the invention. It shows the device in its resting position overimposed on the plan view of the device as indicated by broken lines when the fingerloops of handles 12 and 52 are pressed together and are adjacent to each other. As shown, when 12 and 52 are pressed together, the device at the opposite side will open simultaneously and the distal branches 18 and 28 travel away from each other as far as they can. When 12 and 52 are pressed together the prolonged members 16 and 26 will be bent because of their shape and flexibility. This pivoting action manipulates the elongate elements and causes the coils 40 to travel toward the pivot center. When the handles are released, because of the flexibility and spring action of the prolonged members 16 and 26 the tension of the elements 42 and 56 will be released, causing the coils 40 to return to their original position. FIG. 4B shows a side view of the device in its rested position.

FIG. 4C shows the device in the pressed position and shows the typical prolonged member 26 when it is flexed and bent by the tension of the elongated elements which is mostly concentrated at the coils and it also shows the travel of the coils 40 in respect to location of coils 40 in FIG. 4B.

It is appreciated that the travel and relocation of coils when in contact with skin engages the hairs in it's linear path, plucks and removes the hairs.

Figure 5B:
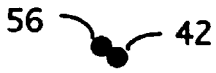
FIG. 5B is a sectional view of the elements at the coils.
Figure 5A:
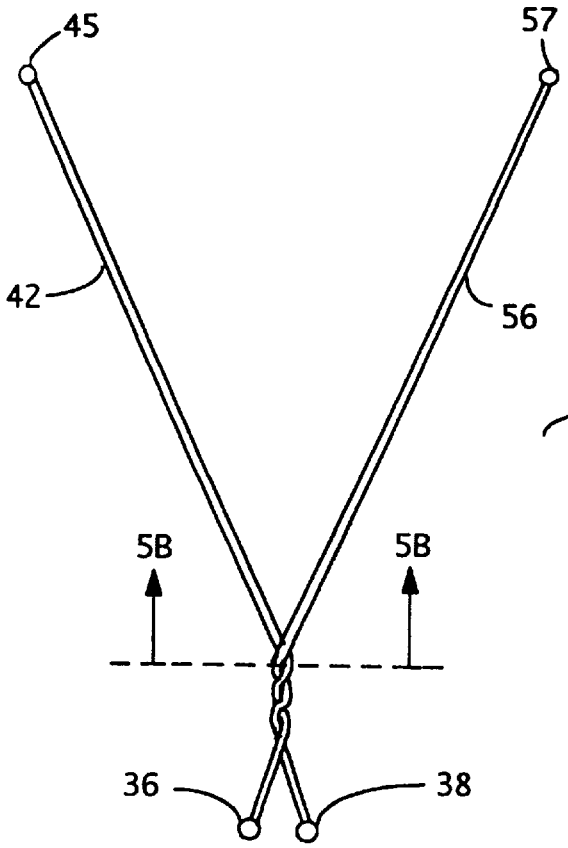
FIG. 5A shows the elongates in the twisted engagement, as to when the handles would be in the rested position.

FIG. 5A shows the preferred embodiment of the hair engagement and removal assembly when positioned as if the handles were at rest. FIG. 5B shows a sectional view of FIG. 5A at location of coil 40.

Figure 5C:
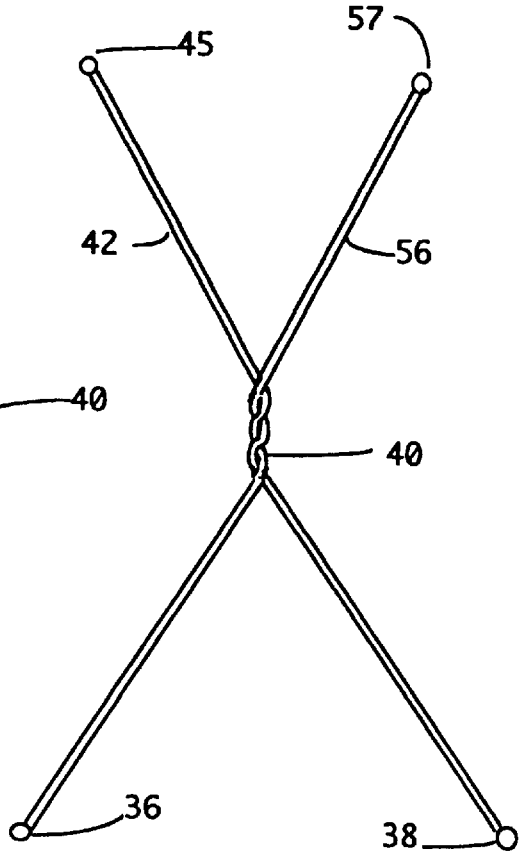
FIG. 5C shows the elements when the handles would be in a closed position.
Figure 6A:
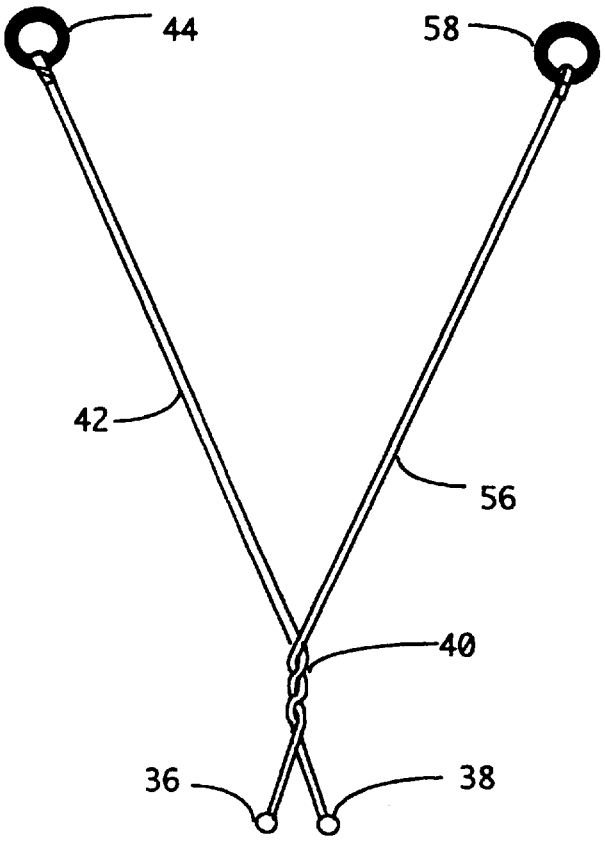
FIG. 6A, shows the elongate elements with the elastic loops attached which is an alternative to the present invention.
Figure 6B:
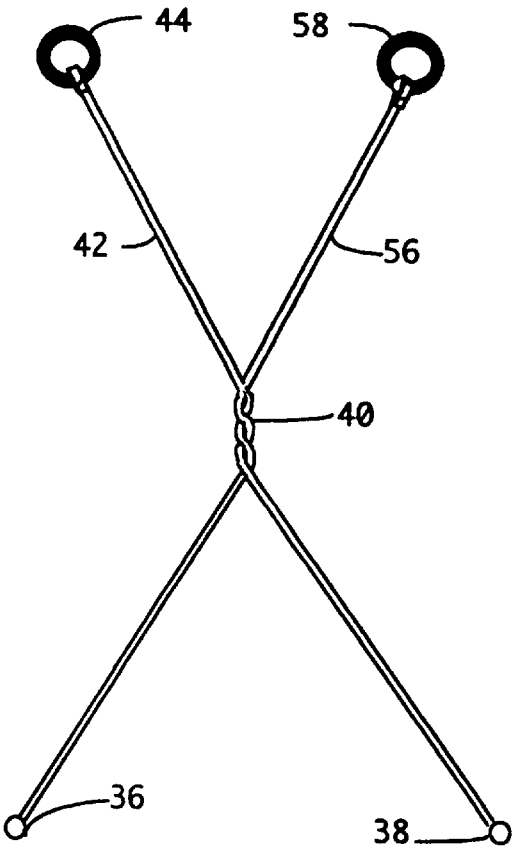
FIG. 6B shows the position of the coils when the handles are pressed.
Figure 7:
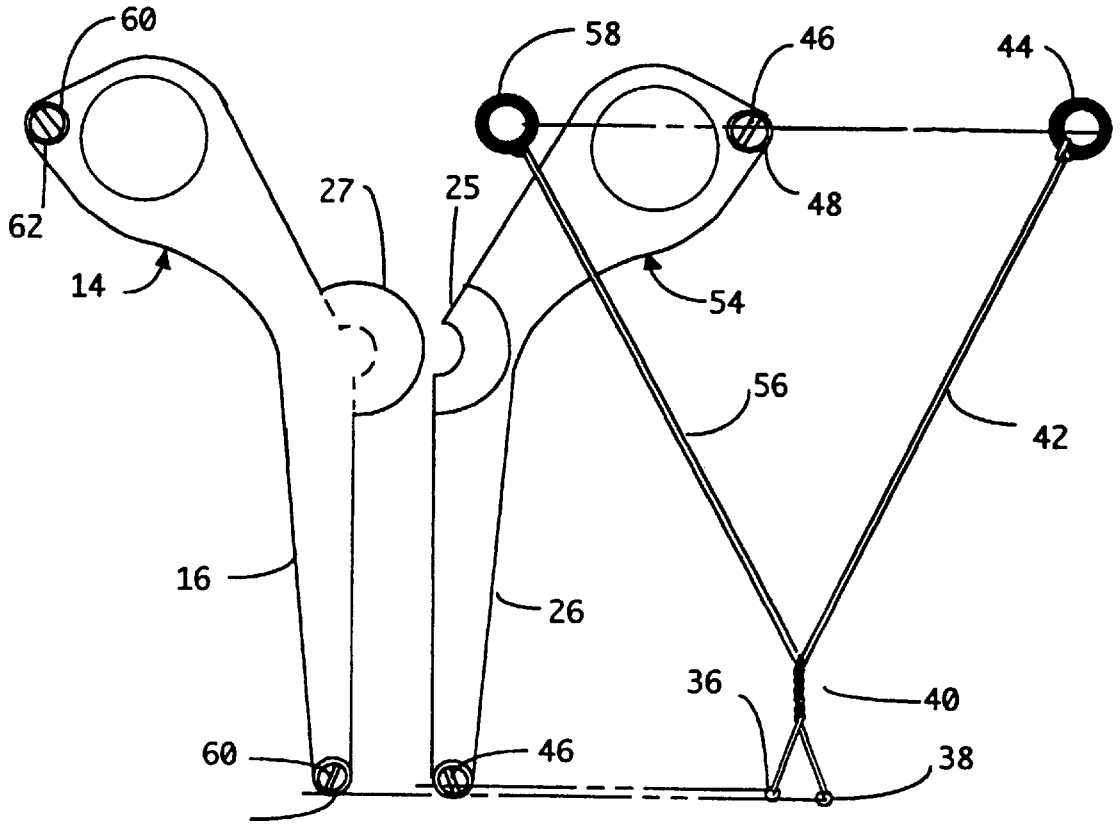
FIG. 7 shows the handles separated, in relation to the elongate elements engaged and twisted, with elastic loops attached (alternative).

FIG. 5C shows the preferred embodiment of the hair engagement and removal assembly when positioned as if the finger loops 12 and 52 of the handles 14 and 54 were pressed together.

Figure 9A:
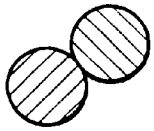
FIGS. 9A and 9B show the enlarged view of the portion of the elongate elements coiled in it's normal operative position.
Figure 9B:
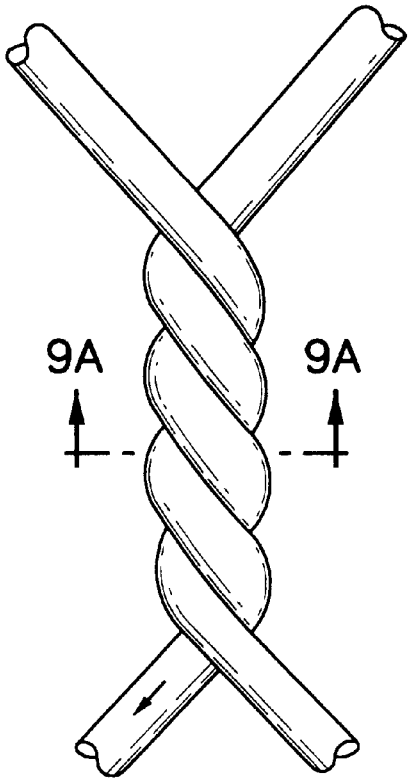

FIGS. 9A and 9B show the enlarged view of the elongate element coiled in it's normal operative position. FIG. 9A is the sectional view of FIG. 9B.

Figure 10:
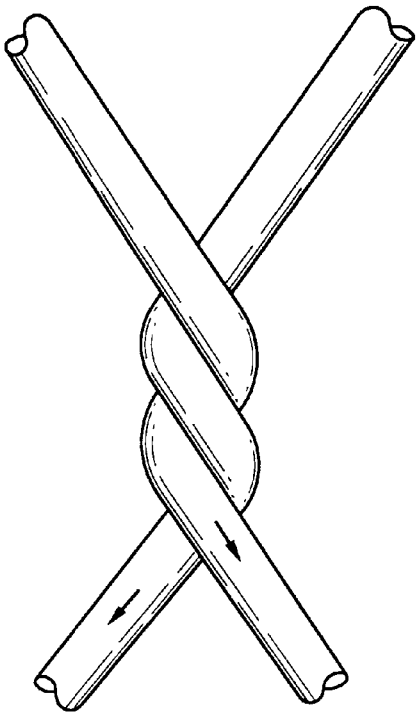
FIG. 10 is the same as FIG. 9A with the exception that the elongate elements are coiled only once, which is another version of the present invention.

FIG. 10 is the same as FIG. 9A with the exception that the elongate elements are coiled only once, which is another version of the present invention.

Figure 11A:
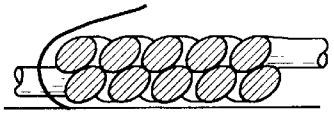
FIGS. 11A, 11B, 11C are three sectional illustrations corresponding to FIGS. 12A, 12B, and 12C.
Figure 11B:
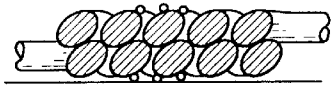
Figure 11C:
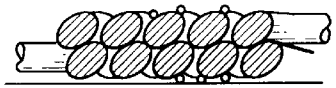
Figure 12A:
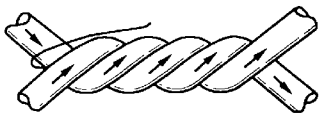
FIGS. 12A, 12B, and 12C are three pectoral illustrations illustrating one example of the hair removal action of the depilatory apparatus of the present invention.
Figure 12B:
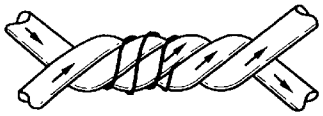
Figure 12C:
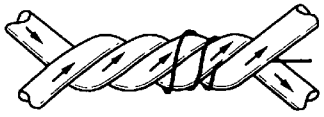

FIGS. 11A, 11B, 11C are three sectional illustrations corresponding to FIGS. 12A, 12B and 12C.

FIGS. 12A, 12B, and 12C are three pectoral illustrations, illustrating one example of the hair removal action of the depilatory apparatus of the present invention.

Figure 13A:
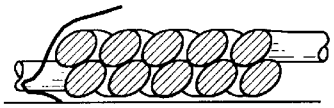
FIGS. 13A, 13B, 13C are three sectional illustrations corresponding to FIGS. 14A, 14B, and 14C.
Figure 13B:
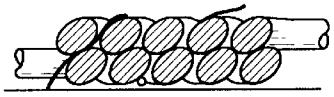
Figure 13C:
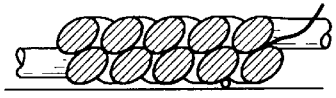
Figure 14A:
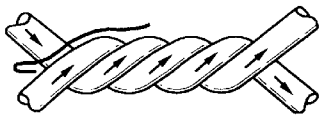
FIGS. 14A, 14B, and 14C are three pectoral illustrations illustrating another example of the hair removal action of the depilatory apparatus to the present invention.
Figure 14B:
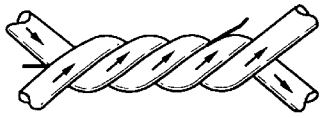
Figure 14C:
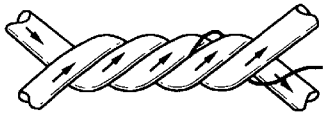

FIGS. 13A, 13B, 13C are three sectional illustrations corresponding to FIGS. 14A, 14B and 14C.

FIGS. 14A, 14B and 14C are three pectoral illustration, illustrating another example of the hair removal action of the depilatory apparatus to the present invention.

FIGS. 6A–8C are related to a second preferred embodiment of the invention.

This secondary preferred embodiment is basically identical to the preferred embodiment of the invention with the following exceptions.

(a) handles 14 and 15 are made of rigid materials (rigid plastics cast aluminum, or any other rigid materials that may be formed with conventional methods).

(b) the prolonged members 16–26 of handles are rigid (not flexible as 16–26 in the preferred embodiment).

Figures 8A, 8B, 8C:
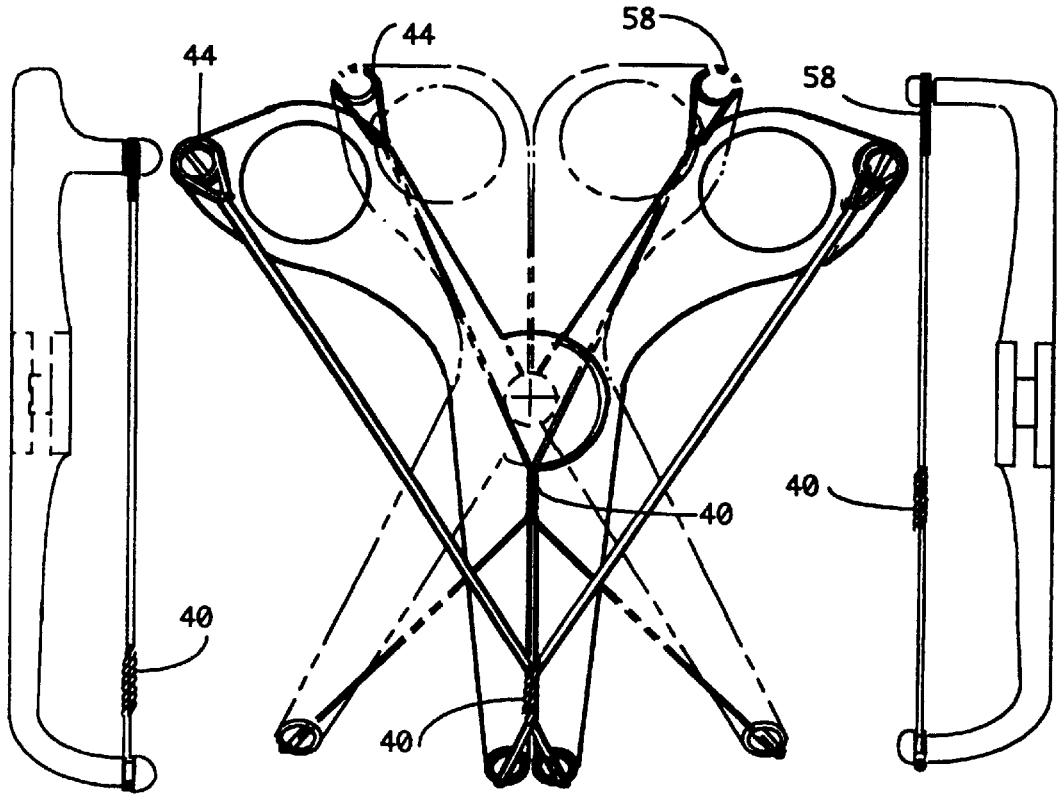
FIG. 8A shows the device in rested and pressed positions, an alternative to the present invention. (Elastic loops added).
FIG. 8B is a side view of the device in the rested position.
FIG. 8C is a side view of the device in pressed position.

(c) to compensate for the needed flexibility and spring action provided by prolonged members; a pair of elastic loops 58–54 are added. As seen in FIGS. 6A–8C the elastic loops 58–54, each are tied to the end of each of the elongate elements shown. When the device is entirely assembled as shown in FIG. 8A the elastic loops are slightly pulled and are each placed around each lead in notch.

The elastic loops have three functions (the same as prolonged members 16–26) the first function is to return or pivot the handles 14 and 54 to their original rested position when handles are pressed together. Another function of the elastic loops is to prevent the deformation of the elongate elements 42–56, while the elements are at a tension, (when handles are in rested position) and when, the tension is considerably increased (when handles are pressed together).

Accordingly, the reader will see that the manual depilatory device is advantageous in many different aspects:

*it is easy to operate.

*it's precise in the manner of which it removes hair.

*it can be operated everywhere. (No use of batteries or electricity).

*it's sanitary, the element that come in contact with skin are changeable so more than one person can use it.

*it can be used privately or by professionals on the public.

*it provides good visibility of hair being removed.

*it can be manufactured inexpensively because the use of minimal parts, simplicity and ease of assembly.

*can remove hair from all parts of the body.

*the user has precise control over the number of hairs being removed.

*can be used by people of almost all ages.

While my above description contains many specifities, these should not be constructed as limitations on the scope of the invention, but rather as an exemplification of one preferred embodiment thereof. Many other variations are possible. For example the handles may not necessarily have finger loops and may use other means of handling the device. The elongate elements instead of having knots at the end could be just tied around the notches, or instead of enlarging the end the element by a knot, certain small clips may be used at the end of the element to enlarge the end of the element. The elastic loops may be used in addition to flexibility of prolonged members to have, better control of the spring actions and the tensions. Larger varieties of this device may be produced specifically and only for the body, and smaller versions of it may be produced for facial use. The fulcrum may be integrated in the handles but not necessarily interlocking, and they may be locked or joined together in the conventional manner by inserting another element in the holes provided at the center of the pivot.

Accordingly, the scope of the invention should be determined not only by the embodiments illustrated, but by the appended claims and their legal equivalents.

I claim:

1. A depilatory device, comprising:

a first base member having a first handle section, a first intermediate pivot section, and a first prolonged section opposite the first handle section relative to the first pivot section;

a second base member having a second handle section, a second intermediate pivot section pivotally joined to the first intermediate pivot section, and a second prolonged section opposite the second handle section relative to the second pivot section;

a pair of first anchors associated with, respectively, the first and second handle sections;

a pair of second anchors associated with, respectively, the first and second prolonged sections; and a pair of elongated elements arranged in mutually twisted engagement, each of the pair of elongated elements having a first end attached to a respective one of the pair of first anchors, and a second end attached to a respective one of the pair of second anchors.

2. The depilatory device of claim 1, including a fulcrum pin pivotally connecting the first intermediate pivot section to the second intermediate pivot section.

3. The depilatory device of claim 1, wherein the first and second handle sections each include a finger loop.

4. The depilatory device of claim 1, wherein the first and second prolonged sections are resiliently flexible.

5. The depilatory device of claim 1, wherein the first and second pair anchors are integrally formed with their respective base members and extend generally perpendicularly therefrom.

6. The depilatory device of claim 5, wherein the first and second anchors each include a groove formed therein for receiving a portion of the respective attached elongated element.

7. The depilatory device of claim 6, wherein the first and second ends of each of the pair of elongated elements is defined by a knot positioned adjacent to the groove of the adjacent anchor.

8. The depilatory device of claim 6, wherein the first and second ends of each of the pair of elongated elements comprises a closed loop retained within the groove of the respective anchor to which the first and second ends are attached.

9. A depilatory device, comprising:

a first base member having a first handle section, a first intermediate pivot section and a first prolonged section opposite the first handle section relative to the first pivot section;

a second base member having a second handle section, a second intermediate pivot section pivotally joined to the first intermediate pivot section by means of a fulcrum pin, and a second prolonged section opposite the second handle section relative to the second pivot section, wherein the first and second handle sections each include a finger loop and the first and second prolonged sections are resiliently flexible;

a pair of first anchors associated with, respectively, the first and second handle sections;

a pair of second anchors associated with, respectively, the first and second prolonged sections, wherein the first and second pairs of anchors are integrally formed with their respective base members and extend generally perpendicularly therefrom; and a pair of elongated elements arranged in mutually twisted engagement, each of the pair of elongated elements having a first end attached to a respective one of the pair of first anchors, and a second end attached to a respective one of the pair of second anchors.

10. The depilatory device of claim 9, wherein the first and second anchors each include a groove formed therein for receiving a portion of the respective attached elongated element.

11. The depilatory device of claim 10, wherein the first and second ends of each of the pair of elongated elements is defined by a knot positioned adjacent to the groove of the adjacent anchor.

12. The depilatory device of claim 10, wherein the first and second ends of each of the pair of elongated elements comprises a closed loop retained within the groove of the respective anchor to which the first and second ends are attached.

* * * * *